US007121480B2

(12) United States Patent
Pontoppidan

(10) Patent No.: US 7,121,480 B2
(45) Date of Patent: Oct. 17, 2006

(54) FUEL INJECTOR AND AN ENGINE INCLUDING SUCH AS INJECTOR

(75) Inventor: Michael Pontoppidan, Colombes (FR)

(73) Assignee: Magneti Marelli Motopropulsion France SAS, Nanterre Cedex (FR)

( * ) Notice: Subject to any disclaimer, the term of this patent is extended or adjusted under 35 U.S.C. 154(b) by 0 days.

(21) Appl. No.: 11/339,643

(22) Filed: Jan. 25, 2006

(65) Prior Publication Data

US 2006/0169804 A1 Aug. 3, 2006

(30) Foreign Application Priority Data

Jan. 26, 2005 (FR) ..... 05 00820

(51) Int. Cl.
*F02M 61/00* (2006.01)
*F02M 47/02* (2006.01)

(52) U.S. Cl. ..... 239/533.12; 239/533.2; 239/533.3; 239/88; 239/453; 123/299; 123/467

(58) Field of Classification Search ..... 239/533.2, 239/533.12, 533.11, 533.3, 533.4, 533.5, 239/533.9, 453, 88; 123/299, 298, 462, 468
See application file for complete search history.

(56) References Cited

U.S. PATENT DOCUMENTS 6,279,840 B1 * 8/2001 Buckley ..... 239/533.4
6,338,445 B1 * 1/2002 Lambert et al. ..... 239/533.12
6,644,268 B1 * 11/2003 Konig et al. ..... 123/299

* cited by examiner

*Primary Examiner*—Dinh Q. Nguyen
(74) *Attorney, Agent, or Firm*—McDonnell Boehnen Hulbert & Berghoff LLP

(57) ABSTRACT

A fuel injector for spraying fuel into a combustion chamber comprises a spray head (6) extending along a central axis (X) from a base (6*a*) to a free end (6*b*), the head comprising a free outside face (6*c*, 6*d*) defining an internal injection combustion (6), and at least two groups (01; 20; 30) of injection orifices, each of the groups (10; 20; 30) of injection orifices comprising a first orifice (11; 21; 31) and at least one second orifice (12; 22; 32), each adapted to spray a fuel jet along a respective first and second directions (D11, D21, D31; D12, D22, D32), the first and second directions forming between them an acute angle (α). All of the internal openings of the injection orifices in each of the groups of orifices are situated substantially in a common plane (P) extending substantially transversely relative to the central axis (X) of the head (6) of the injector. The injector particularly intended for a direct-injection diesel engine.

18 Claims, 2 Drawing Sheets

FUEL INJECTOR AND AN ENGINE INCLUDING SUCH AS INJECTOR

This application claims priority under 35 U.S.C. § 119, via the Paris Convention for the Protection of Industrial Property, to French patent application number FR 05 00820, filed Jan. 26, 2005, which is hereby incorporated by reference.

The present invention relates to a fuel injector for spraying fuel into a combustion chamber of an internal combustion engine. More particularly, it relates to a fuel injector comprising a body for securing to the engine and a spray head extending along a central axis from a base connected to the body to an end that is free, said head including an internal injection chamber, a free outside face extending between the base and the free end, and including a plurality of injection orifices constituted by at least two groups of injection orifices extending from an internal opening situated in the injection chamber to an external opening situated in the outside face, each of said groups of injection orifices comprising a first orifice and at least one second orifice, each adapted to spray a jet of fuel in a respective first and second directions, said first and second directions forming between them an acute angle in such a manner that the jets from a group of orifices intercept in a so-called "bursting" zone situated at a distance from the outside face.

This type of injector, e.g. as known from document US-A-20020000483, enables a particularly high degree of fuel atomization to be obtained because of the bursting of each jet produced from the interception point of this jet by the other jet(s) of this group of injection orifices. In addition, the kinetic energy of the fuel in a jet is reduced as from the bursting zone, thereby limiting penetration of the jet into the combustion chamber and preventing fuel being sprayed onto the walls of the cylinder which might lead to unburnt fuel being emitted. This limitation of the penetration of the jet is also reinforced by the fact that, beyond the bursting zone, the speed of the fuel presents a component that is radial relative to the injection direction.

It is particularly advantageous to use this type of injector that enables spraying in the combustion chamber to be made uniform, in high-pressure direct-injection diesel engines having one injector per cylinder.

Nevertheless, with that type of prior art injector, it has been found that the bursting of the fuel jets from a group of orifices does not always take place in optimum manner. It is found that under certain conditions, firstly the jets produced by the first and second orifices of a group are not exactly simultaneous, which can lead to one of the jets not bursting for a brief instant, and secondly the characteristics of the first and second jets, e.g. their flow rates, do not vary in proportional manner, thereby leading to greater or lesser deflection beyond the bursting zone of the jet formed by one group of orifices. Those phenomena have harmful effects on the atomization of the fuel and on the uniformity of the air/fuel mixture inside the combustion chamber, and consequently on the emission of pollution. Those phenomena are all the more harmful in that their magnitude tends to increase when the injection pressure is increased towards high values, nowadays of the order of 2000 bars, and when it is desired to reduce the duration of injections so as to be able to increase the number of injections during one cycle, even though increasing injection pressure and the number of injections per cycle are generally considered as being factors that can improve combustion.

An object of the present invention is to avoid the appearance of those phenomena that have unfavorable effects on optimizing combustion and on reducing the emission of pollution, by proposing an injector of the above-specified type in which the bursting of the jets of fuel takes place in the expected manner, at least under most operating conditions of the engine.

To this end, the invention provides a fuel injector of the above-specified type, characterized in that all of the internal openings of said plurality of orifices are situated in a common plane extending substantially transversely relative to the central axis of the spray head.

By means of this disposition, it is found that all of the fuel jets produced by the set of orifices of the head are indeed simultaneous, even when modifying the operating conditions of the injector in significant manner. Furthermore, the jets that result from bursting the jets produced by each group of orifices present a shape that is substantially constant overall during any one injection or when the feed pressure to the injection chamber varies.

This result might be explained by the fact that the internal openings of all of the orifices of the injector made in accordance with the invention are situated at a common longitudinal position along the injection chamber, in which longitudinal position the pressure of the fuel must be substantially identical around the entire periphery of the injection chamber. Given ever-increasing fuel pressures, the close-together opening and closing operations of the injection chamber, and the ever-smaller diameters of the orifices, fluid flow phenomena occur in the injection chamber and the orifices that disturb the formation of fuel jets, such as turbulence, head losses along the central axis of the chamber, and the appearance of pressure waves that can be reflected against the walls of the chamber and that can become superposed, possibly even leading to localized cavitation phenomena, which can fundamentally change the feed to the orifices by leading to partial obstructions.

Furthermore, it should be observed that this disposition of the orifices in the injection head presents advantages in manufacturing the injector. To make an injector of the kind described in document US-A-20020000483, in order to make the various orifices of a group of injection orifices, it is necessary either to change the angle of inclination of the tool relative to the central axis, or else to use two distinct tools in order to make the first and second orifices, respectively. However with an injector made in accordance with the invention, where all of the orifices present the same angle of inclination relative to the central axis, it is only necessary to cause the tool to pivot about an axis that is parallel to the central axis, thus providing greater precision and greater speed of implementation.

In preferred embodiments of the invention, recourse may also be had to one or more of the following dispositions:

- the spray directions from all of the orifices lie in the common plane extending transversely relative to the central axis;
- the first and second orifices of a group form between them an angle lying in the range 15° to 50°, and presenting a bisector that extends radially relative to the central axis;
- the groups of injection orifices are distributed angularly around the periphery of the outside face in regular manner;
- the first orifices are identical in profile e.g. cylindrical or frustoconical, to the second orifices;
- the outside face presents a portion that is cylindrical and coaxial about the central axis, with the outside openings of the injection orifices being situated therein;

the injection chamber presents a wall portion that is cylindrical and coaxial about the central axis, and in which the internal openings of the injection orifices are situated;

all of the injection orifices are substantially identical in length, such that the drop in pressure through them are approximately equal to one another regardless of the pressure of the fuel; and three groups of injection orifices are provided, each of the three groups comprising two orifices.

The above-defined fuel injector is particularly suitable for implementing direct injection into a diesel engine by securing the injector body to the cylinder head of the engine and by arranging the injector head in the combustion chamber.

Other characteristics and advantages of the invention appear from the following description given by way of non-limiting example and made with reference to the accompanying drawings, in which.

In the various figures, the same references are used for designating elements that are identical or similar.

Figure 1:
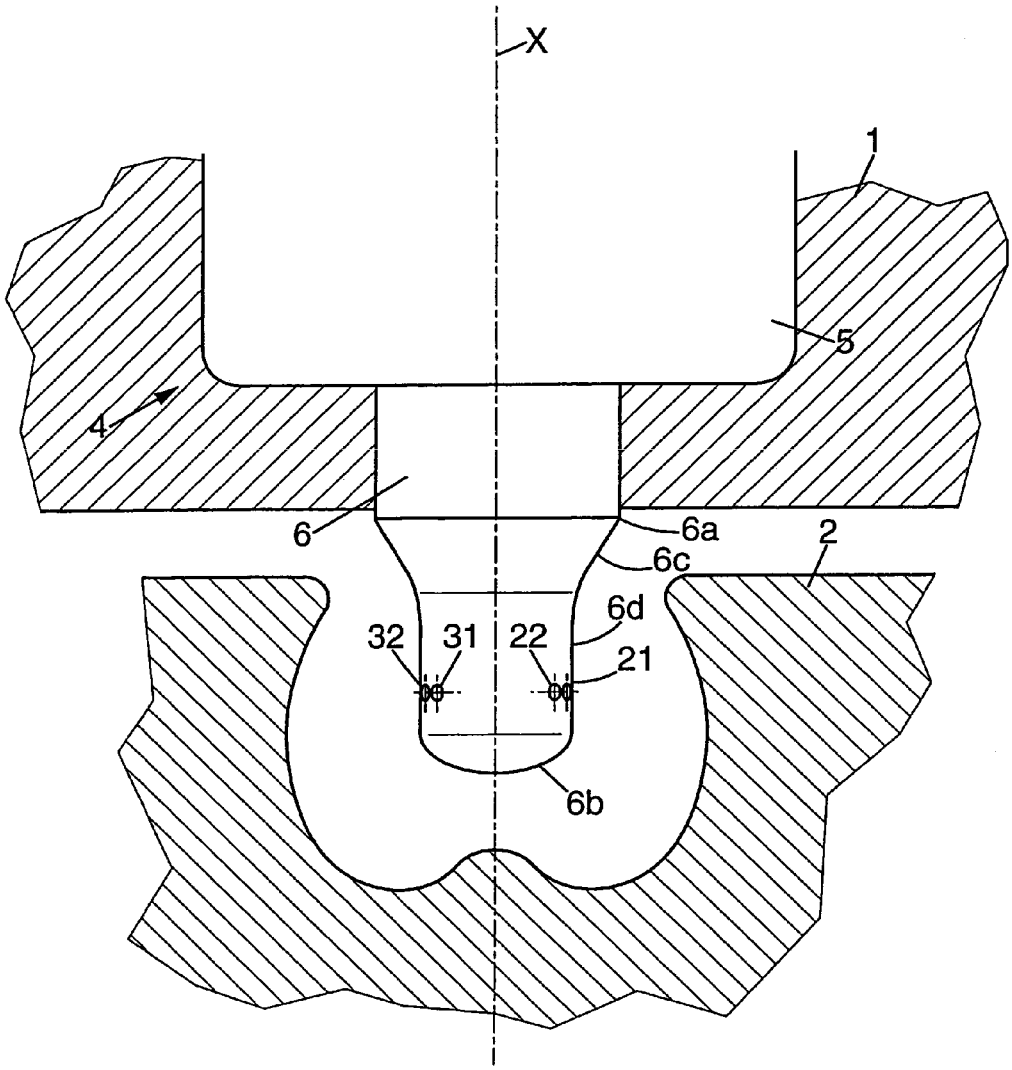
FIG. 1 is a diagrammatic section view of a direct injection combustion chamber including an injector of the invention.

FIG. 1 is a diagram in cross-section showing a portion of a combustion chamber of a diesel engine. The chamber lies between a cylinder head 1 and a reciprocating piston 2 that presents a central recess in a manner that is well known for direct-injection diesel engines.

The cylinder head 1 is provided with an injector given overall reference 4, which injector comprises a body 5 secured to the cylinder head and a spray head 6 extending along a central axis X from a base 6*a* secured to the body 5 to a free end 6*b* arranged in the combustion chamber. In the embodiment shown, the central axis X of the injector 4 coincides with the axis of the cylinder, however it is entirely possible for the central axis of the injector to be offset and/or inclined relative to the axis to the cylinder.

In the embodiment shown, the head 6 of the injector presents an outside surface which, on going away from the base 6*a* of the head, comprises a frustoconical portion 6*b*, followed by a cylindrical portion 6*d* coaxial about the axis X, and terminated by the free end 6*b*. The head includes an internal chamber 7 referred to as an injection chamber.

Figure 3:
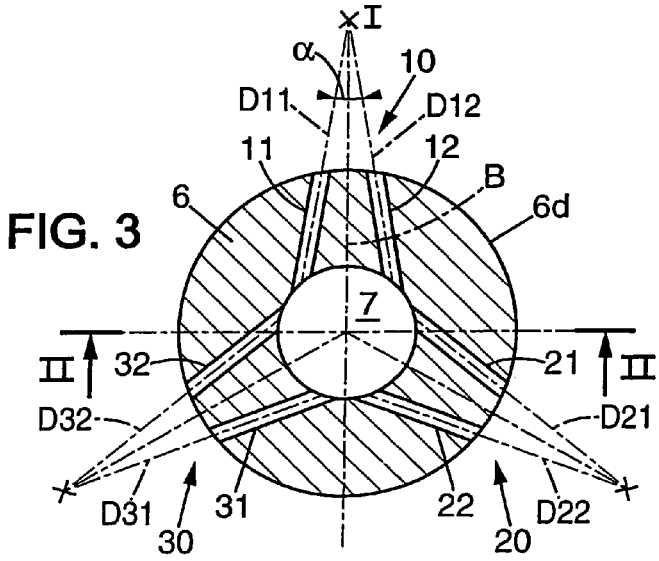
FIG. 3 is a diagrammatic cross-section view on line III—III of FIG. 2.

As can be seen more clearly in FIG. 3, the injector head has three groups (10, 20, 30) of injection orifices. Each group of injection orifices comprises a first orifice (11; 21; 31) associated with a second orifice (12; 22; 32).

Each of these orifices (11, 12, 21, 22, 31, 32) extends from an internal opening situated inside the injection chamber 7 to an external opening situated in the cylindrical portion 6*d* of the outside face.

The injection chamber 7 is selectively put into communication with a feed chamber 8 containing fuel under high pressure, preferably a pressure greater than one thousand bars. The fuel may be delivered to the feed chamber 8 by any known device, and in particular by a common injection rail.

Figure 2:
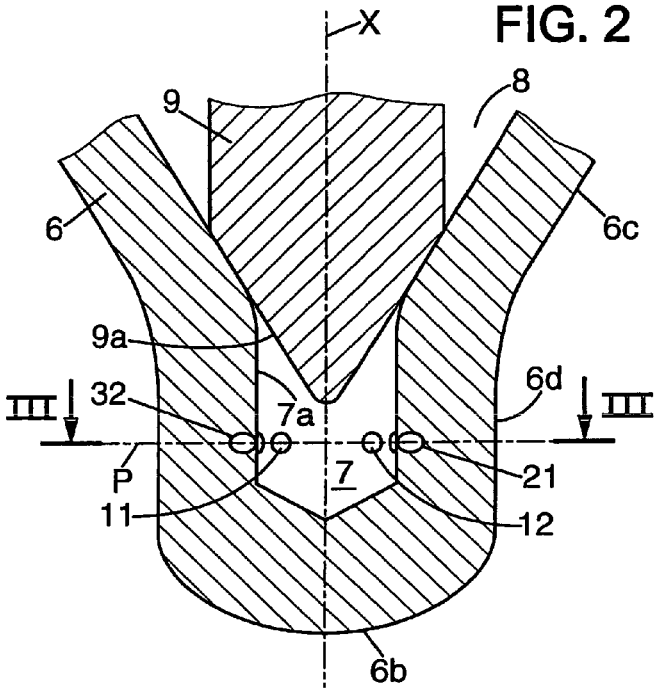
FIG. 2 is a longitudinal section view on line II—II of FIG. 3, on a larger scale and showing the head of the FIG. 1 injector.

The injection chamber 7 is put into communication with the feed chamber 8 by moving a needle 9 along the central axis X away from a closed position as shown in FIG. 2 in which a conical portion 9*a* of the needle is pressed against a complementary seat separating the injection and feed chambers (7, 8). The movements of the needle 9 are controlled by any known device, and in particular by an electromagnetic device or a piezoelectric device, preferably under the control of an electronic engine management module that controls the engine as a function of its operating parameters, acting on the needle 9 either directly or via a hydraulic amplifier system.

In the open position, the needle 9 is spaced apart from the seat in order to allow direct communication between the feed chamber 8 and the injection chamber 7 so as to minimize head losses between these chambers. The lift of the needle 9 between the closed position and the open position is as short as possible in order to reduce the flight time and the ballistic time of the needle.

With reference to the first group 10 of orifices, the first orifice 11 is a cylindrical hole extending in a first direction D11 suitable for spraying a jet of fuel along said direction D11. Similarly, the second orifice 12 is adapted to spray a jet of fuel along a second direction D12. Nevertheless, the orifices could present profiles that are conical, e.g. flaring towards their external openings.

The first and second orifices 11 and 12 are arranged relative to each other in such a manner that the first and second directions (D11, D12) form between them an acute angle $\alpha$, intersecting at a point I situated at a distance from the cylindrical portion 6*d* of the outside face of the head 6. Thus, the jets of fuel leaving via the first and second orifices (11, 12) come into collision leading to a major loss of kinetic energy from the liquid fuel, and also generating a speed component that is radial relative to the respective directions (D11, D12). This increases the atomization of the fuel into fine droplets and limits the depth to which the jets of fuel penetrate into the combustion chamber. This achieves increased atomization, encouraging more uniform mixing, and thus encouraging better-controlled oxidation of the fuel. This has the consequence of limiting the emission of pollution and in particular the quantity of particles.

Each of the second and third groups (20, 30) of orifices comprises respective first and second orifices (21, 31; 22, 32) arranged relative to one another in pairs in a manner analogous to that of the first group 10 of orifices.

As can be seen better in FIG. 2, all of the orifices (11, 12, 21, 22, 31, 32) in all of the groups of orifices (10, 20, 30) lie in a common plane, referenced P, extending perpendicularly to the central axis X, with the spray directions (D11, D12, D21, D22, D31, D32) all lying exactly in this plane. By means of this disposition, the orifices can be machined using tools capable of moving solely in translation in the plane P, e.g. one tool that moves along the direction D11 and another tool that moves along the direction D22 for making the orifices 11 and 12 simultaneously, with the other orifices being made after the injector head 6 has been turned about the central axis X. The spray orifices can also be made using a single tool mounted on a support that allows it to pivot in the plane P about a pivot point coinciding with the point of intersection I.

Furthermore, it should be observed that this disposition of the orifices (11, 12, 21, 22, 31, 32) ensures that their internal openings in the injection chamber 7 are situated at a common longitudinal position along said chamber, and that consequently all of the orifices are fed with fuel at the same pressure. Thus, the jets produced by the first and second orifices are accurately simultaneous and they are made up of fuel at the same pressure. It is thus ensured that the jets from each of the groups of orifices are burst throughout the entire duration of an injection, unlike certain prior art injectors in which the openings of the orifices into the injection chamber are situated in different longitudinal positions, positions where fuel pressure can momentarily be significantly different because of pressure losses, turbulence, or pressure waves produced by the needle being lifted. The collision of the jets also leads to the fuel being atomized, even if the pressure of the fuel in the injection chamber 7 has not reached the nominal operating pressure, and this is particularly advantageous for injections of very short duration.

It should also be observed that because the orifices open out into the injection chamber 7 at substantially the same longitudinal position, it is possible to reduce the length of the chamber along said central axis X, thereby reducing its volume, and thus reducing losses of fuel via the orifices between two injections.

These advantages associated with the orifices being in a coplanar disposition mean that the injector of the invention is particularly well suited for implementing injections of very short duration under very high pressure. This structure for the head is well adapted for being associated with injector actuators capable of implementing a plurality (e.g. five or seven) of injections in series during a cycle, the injections being grouped as pre-injections, a main injection, and post-injections.

Although the injection directions (D11, D12, D21, D22, D31, D32) in the preferred embodiment all lie in the same plane P perpendicular to the central axis, it is possible to provide for the directions to depart from the plane P, e.g. by a few degrees, so that the external openings of the orifices do not lie in said plane, but on condition that the internal openings all remain in the same perpendicular plane P in order to conserve the main advantages of the present invention.

The angle $\alpha$ formed between the first orifice 11 and the second orifice 12 of the first group 10 preferably lies in the range 15° to 50° so as to obtain a collision angle that is sufficiently large, but without excessively increasing the spacing between the internal openings of a group of orifices. Naturally, this range of values for the angle $\alpha$ is not limiting, and the angle $\alpha$ may be increased when the diameter of the cylindrical portion 6*d* of the head is increased. However, when the diameter of the head is increased, it is also possible to increase the number of groups of orifices, e.g. in order to obtain four groups, each of two orifices at an angle $\alpha$ lying the stated range.

The first and second orifices (11, 12) are arranged relative to each other and the central axis X in such a manner that the bisector B of the angle $\alpha$ formed between them extends radially relative to the central axis X. Thus, the angles of the outlets of the first and second orifices (11, 12) relative to the outside surface 6*d* of the injector head 6 are symmetrical. Furthermore, when the head 6 has a wall of constant thickness, the first and second orifices are identical in length, thus making it possible to obtain the same head loss through each of them.

The first and second orifices (11, 12) are constituted by holes having the same cylindrical or conical profile, thus limiting any risk of dispersion between the characteristics of the jets depending on operating conditions or while spraying is taking place. For example, in the embodiment shown, all of the orifices are cylindrical holes having the same diameter. However, the present invention naturally does not exclude groups of injection orifices having diameters that are significantly different.

In the embodiment shown, the injector head has three groups of orifices (10, 20, 30), each comprising two orifices (11, 12; 21, 22; 31, 32), thus making it possible to obtain mixing in the combustion chamber that is sufficiently uniform, while minimizing the number of orifices that need to be machined. Nevertheless, it is possible to multiply the number of groups of orifices, while preferably distributing them in regular manner around the periphery of the injector head.

Furthermore, it is possible to provide for each group of orifices to have more than two orifices, e.g. a main orifice extending for example in a radial direction relative to the central axis X and lying between two secondary orifices, possibly of smaller diameter, and oriented in such a manner that the jets of fuel leaving via these secondary orifices intercept the jet formed by the main orifice.

In the embodiment shown, the portion 6*d* of the outside face into which the orifices open out, and the inside face 7*a* of the injection chamber 7, are both cylindrical and coaxial about the central axis X. Thus, when manufacturing the injector, there is no need to identify a particular angular position relative to the injector in order to drill the orifices, it is only the angular position relative to the first-drilled orifice that needs to be taken into account when drilling the other orifices. This also makes it possible to obtain a wall of constant thickness and of shape adapted to withstand high pressures. However, the injector head could naturally also present a cross-section that is generally triangular, square, or hexagonal, depending on the number of groups of orifices, and without thereby going beyond the ambit of the present invention. Similarly, the outside shape of the head could be different, for example it could be generally cylindrical or conical.

The invention claimed is:

1. A fuel injector for spraying fuel into a combustion chamber of an internal combustion engine, the injector comprising a body (5) for securing to the engine and a spray head (6) extending along a central axis (X) from a base (6*a*) connected to the body to an end (6*b*) that is free, said head (6) including an internal injection chamber (7), a free outside face (6*c*, 6*d*) extending between the base and the free end, and including a plurality of injection orifices constituted by at least two groups (10, 20, 30) of injection orifices extending from an internal opening situated in the injection chamber (7) to an external opening situated in the outside face (6*d*), each of said groups (10; 20; 30) of injection orifices comprising a first orifice (11; 21; 31) and at least one second orifice (12; 22; 32), each adapted to spray a jet of fuel in a respective first and second directions (D11, D21, D31; D12, D22, D32), said first and second directions forming between them an acute angle ($\alpha$) in such a manner that the jets from a group of orifices intercept in a so-called "bursting" zone situated at a distance from the outside face, the injector being characterized in that all of the internal openings of said plurality of orifices are situated in a common plane (P) extending substantially transversely relative to the central axis (X) of the head (6) of the injector.

2. An injector according to claim 1, wherein the spray directions (D11, D12, D21, D22, D31, D32) from all of the orifices (11, 12, 21, 22, 31, 32) lie in the common plane (P) extending transversely relative to the central axis (X).

3. An injector according to claim 1, wherein the first (11; 21; 31) and second (12; 22; 32) orifices of a group (10; 20; 30) form between them an angle ($\alpha$) lying in the range 15° to 50°, and presenting a bisector (B) that extends radially relative to the central axis (X).

4. An injector according to claim 1, wherein the groups (10, 20, 30) of injection orifices are distributed angularly around the periphery of the outside face (6*c*, 6*d*) in regular manner.

5. An injector according to claim 1, wherein the first orifices (11, 21, 31) are identical in profile to the second orifices (12, 22, 32).

6. An injector according to claim 1, wherein the outside face presents a portion (6*d*) that is cylindrical and coaxial about the central axis (X), with the outside openings of the injection orifices (11, 12, 21, 22, 31, 32) being situated therein.

7. An injector according to claim 1, wherein the injection chamber (7) presents a wall portion (7*a*) that is cylindrical and coaxial about the central axis (X), and in which the internal openings of the injection orifices (11, 12, 21, 22, 31, 32) are situated.

8. An injector according to claim 1, wherein all of the injection orifices (11, 12, 21, 22, 31, 32) are substantially identical in length.

9. An injector according to claim 1, wherein three groups (10, 20, 30) of injection orifices are provided, each of the three groups comprising two orifices (11, 12; 21, 22; 31, 32).

10. A diesel engine comprising an injector (4) according to claim 1, wherein the body (5) of the injector is secured to the cylinder head (1) of the engine and the head (6) of the injector is arranged in the combustion chamber.

11. A diesel engine comprising an injector (4) according to claim 2, wherein the body (5) of the injector is secured to the cylinder head (1) of the engine and the head (6) of the injector is arranged in the combustion chamber.

12. An injector according to claim 2, wherein the first (11; 21; 31) and second (12; 22; 32) orifices of a group (10; 20; 30) form between them an angle ($\alpha$) lying in the range 15° to 50°, and presenting a bisector (B) that extends radially relative to the central axis (X).

13. An injector according to claim 2, wherein the groups (10, 20, 30) of injection orifices are distributed angularly around the periphery of the outside face (6*c*, 6*d*) in regular manner.

14. An injector according to claim 2, wherein the first orifices (11, 21, 31) are identical in profile to the second orifices (12, 22, 32).

15. An injector according to claim 2, wherein the outside face presents a portion (6*d*) that is cylindrical and coaxial about the central axis (X), with the outside openings of the injection orifices (11, 12, 21, 22, 31, 32) being situated therein.

16. An injector according to claim 2, wherein the injection chamber (7) presents a wall portion (7*a*) that is cylindrical and coaxial about the central axis (X), and in which the internal openings of the injection orifices (11, 12, 21, 22, 31, 32) are situated.

17. An injector according to claim 2, wherein all of the injection orifices (11, 12, 21, 22, 31, 32) are substantially identical in length.

18. An injector according to claim 2, wherein three groups (10, 20, 30) of injection orifices are provided, each of the three groups comprising two orifices (11, 12; 21, 22; 31, 32).

* * * * *